United States Patent [19]

Feess et al.

[11] 4,046,506

[45] Sept. 6, 1977

[54] PROCESS AND DEVICE FOR THE CONTINUOUS DYEING OF TEXILE WEBS OF SYNTHETIC OR MOSTLY SYNTHETIC FIBRE MATERIALS

[75] Inventors: Erich Feess, Hofheim, Taunus; Hans-Peter Maier, Sulzbach, Taunus, both of Germany

[73] Assignee: Hoechst Aktiengesellschaft, Frankfurt am Main, Germany

[21] Appl. No.: 541,564

[22] Filed: Jan. 16, 1975

[30] Foreign Application Priority Data

Jan. 18, 1974 Germany ..... 2402328

[51] Int. Cl.[2] ..... D06P 3/82

[52] U.S. Cl. ..... 8/21 R; 8/22; 8/39 C; 8/41 C; 8/54.2; 8/176; 8/178 R; 8/179

[58] Field of Search ..... 8/21 R, 170, 22

[56] References Cited

U.S. PATENT DOCUMENTS 3,702,752 11/1972 Bent et al. ..... 8/2.5

FOREIGN PATENT DOCUMENTS

| | | |
|---|---|---|
| 705,614 | 6/1931 | France |
| 2,001,507 | 7/1970 | Germany |
| 969,623 | 9/1964 | United Kingdom |
| 1,001,456 | 8/1965 | United Kingdom |
| 939,170 | 10/1963 | United Kingdom |

*Primary Examiner*—Joseph L. Schofer
*Assistant Examiner*—A. L. Clingman
*Attorney, Agent, or Firm*—Curtis, Morris & Safford

[57] ABSTRACT

The invention relates to a process for the continuous dyeing of textile webs of synthetic fibres or mostly synthetic fibre materials with suitable dyestuffs and dyestuff fixation according to a usual method, wherein the padding operation of the fibrous material with an aqueous dyebath having a relatively high concentration and squeezing off the excess of liquid is effected while pressing from both sides endless webs of an absorbent fibre material (auxiliary webs) onto the material to be dyed.

3 Claims, 2 Drawing Figures

Figure 1:
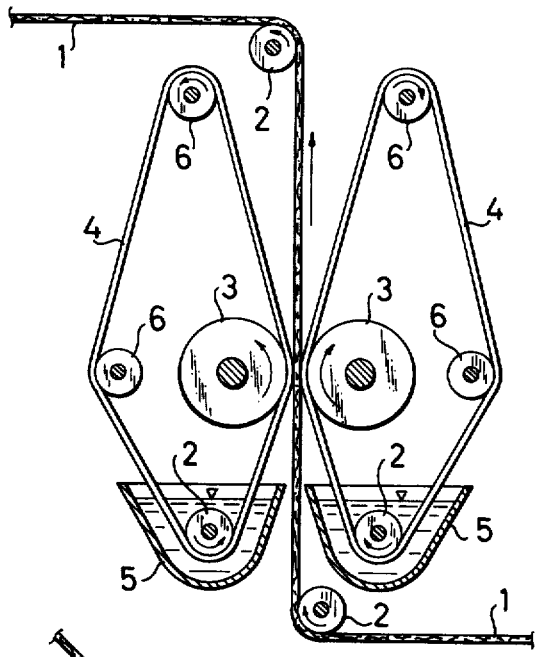

PROCESS AND DEVICE FOR THE CONTINUOUS DYEING OF TEXILE WEBS OF SYNTHETIC OR MOSTLY SYNTHETIC FIBRE MATERIALS

In the preparation of pad dyeings there is always the risk of a dyestuff migration on the textile material treated with aqueous dyeing liquors. Apart from the fact that such migration can appear in the case of determined dyestuffs already when the material enters the impregnation chassis, said migration essentially takes place in the course of the drying process before the fixation of the dyestuffs. However, a completely even application of the padding liquor onto the material by the foulard is always taken for granted when considering this problem.

The following points have to be considered as causes for a migration of dyestuffs when drying fibre material impregnated with these dyestuffs.

This negative fact is favored to a large extent by a high substantivity of the dyestuffs used. A small substantivity of the dyestuffs at the padding and drying temperature is, therefore, desired. Thus, in the padding process, dyestuffs having a low substantivity are preferred.

The migration is favored by a high liquor pick-up of the textile articles.

The tendency to migration of the dyestuffs is higher in the case of synthetic fibre materials than of natural fibres since the swelling water portion in synthetic fibres is only poor as compared with the water adhering only to the surface.

A migration of the dyestuff due to an uneven drying on both sides finally leads to two-sidedness of the dyeings produced. The easier the liquid phase can be displaced the easier is migration. This is another reason why the risk of migration is higher in the case of synthetic fibres.

Thus, a migration of the dyestuff can be avoided or reduced by the following measures.

Care must be taken that the liquor pick-up is as low as possible during the padding process.

Furthermore, the moist fabric must be allowed to dwell before drying; but this step only proves right, if already tinctorial processes, for example exhaustion or reacting, take place under the dwelling conditions.

Drying must be carried out evenly over the full width of the material and uniformly from both sides.

A drying of the moist paddings by evaporating the liquid phase due to the absorption of radiation energy is more suitable than drying by the action of air at high wind speeds. Thus, it is known in this respect that the drying by infrared radiation causes less migration, at least in the beginning, than the so-called jet drying.

It has now been found that in the continuous dyeing of textile webs of synthetic fibres or mostly synthetic fibre materials with suitable dyestuffs a large number of the abovementioned rather difficult requirements with regard to avoiding the dyestuff migration can be met in a simple way by effecting the padding process with an aqueous dyestuff liquor having a relatively high concentration and squeezing off the liquid excess by pressing from both sides endless webs of an absorbent fibre material (auxiliary web) onto the material to be dyed. The dyestuffs applied are fixed according to a usual method.

According to the process of the invention the textile material treated with the dyeing liquors is not subjected, as usual, to intermediate drying with supply of heat in order to remove the liquid; but first, by absorption of the excess liquor only adhering to the surface the content of liquid on the synthetic fibre web is reduced to a fraction of the otherwise usual content of residual liquor. This absorption of humidity in contact with the hydrophilic accompanying fabric webs (sandwich package) takes place at the usual padding temperature, that is to say, no energy is used for this phase of drying.

For the practicability of the novel process it is important to know that cloths of absorbent fibres, for example cotton or spun rayon, having only a small content of residual moisture, are able to remove the adhering water from the surfaces of synthetic fibres. Such natural fibres are also to absorb the liquid from the hollow spaces between the threads of woven or knitted fabrics of synthetic fibres retaining after a squeezing process large amounts of padding liquor; the result is that only a thin adhering liquid film envelopping these textiles from all sides remains on the synthetic fibres. This film is, thus, very evenly distributed.

As absorbent accompanying webs there may also be used webs consisting of a synthetic basic fabric and being flocked with cellulose fibres. The use of articles of towelling material having a form of uncut pile or cut pile is also advantageous. To reduce the moisture content of particularly light woven or knitted fabrics a normal cotton material is sufficient; in the case of heavier materials there may be used for example textiles napped on one side, for example duvetine.

The accompanying cloths absorbing the moisture from the material padded with the dyestuffs are expediently conducted in a cycle. If the material to be dyed is a very thin synthetic material it is sufficient to submerge only the accompanying fabrics into the padding liquor. The liquor pickup thereof is sufficient to supply the web consisting of the synthetic fibres or of a mixture of synthetic, for example polyester fibres, and cotton fibres, with the dyebath. However, the first condition for the use of the process claimed is that of the textiles to be dyed at least half of the fibres have a synthetic origin. Normally, however, the three material webs are led through the dyebath and then squeezed off together. Whereas, for example, on a fabric of texturized polyester endless fibres, when squeezing off according to a conventional method, 136% of the material weight of padding liquor remain on the surface, the liquor eontent of the same fabric, when squeezed off in a sandwich package between two velveteen webs, is only 24.5% by weight.

The new process in which there is no action of heat for removing the liquid from the material is, thus, interesting for the one reason that the consumption of energy for drying is considerably reduced. This allows, on one hand, to do without an infrared radiation of the moist material for the previous drying which is usually applied before a conventional drying operation with regard to a reduction of the risk of migration of the dyestuffs; on the other hand, it is possible by this way, because of the considerably reduced need of energy, to use for the final drying more expensive energies with a lower expenditure of apparatus. In the present case, for example, the high frequency drying becomes interesting. But also when using conventional drying devices to eliminate the residual moisture the operation may be carried out with a reduced temperature and wind speed and with a smaller risk of migration for the dyestuffs. After carrying out the process of the invention the amount of water still to be eliminated by drying is only a fraction of the amount corresponding to the conventional methods and this fraction is, at any rate, less mobile, that is to say, more adhering to the fibre; therefore, in the course of the after-drying even paddings are obtained with a very increased drying capacity despite milder drying conditions even on conventional apparatus.

As compared with the padding methods hitherto usual the process claimed requires, by nature, a highly increased concentration of the padding liquor in the dyestuff content, inasmuch as, accordingly, smaller amounts of liquor remain on the fibre. A certain drawback of the novel process consists in the fact that the accompanying fabrics have to be replaced by new ones or subjected to intermediate drying when passing from one shade to another. This can be easily realized by constructive measures on foulard and conducting rollers.

The absorbent accompanying fabrics (auxiliary webs) circulated according to the present invention shall be seamless; this can be realized especially by a subsequent flocking of a basic fabric. Pile materials napped or cut on one side may be welded nearly without seam for example by polyamide foils. According to the invention normal seams lead to visible marks of the seam on the material to be dyed.

Furthermore, according to the process claimed the squeezing off process itself has no distording or squeezing influence even on heavier synthetic fibre fabrics, for example texturized polyester or polyamide fibres, since these materials are protected by the treatment in the sandwich package, whereas in the normal padding process considerable risks arise in this respect.

The accompanying fibre fabrics have advantageously the same width as the foulard rollers or they are somewhat wider, in order to avoid the so-called shrinkage of the material at the supporting places of the edges, i.e. to avoid an uneven wear and tear of the rollers.

The device of the invention is shown diagrammatically by way of example of the accompanying drawings. The principle of the device is described in FIG. 1. The fibre material 1 to be treated with the padding liquor and then to be freed from water is introduced via a diverting roller 2 with a moderate pressure vertically from below to above into a strong squeezing device consisting of two rollers 3. Simultaneously, two endless circulating absorbent webs 4 enter the squeezing device from below via diverting rollers 2 each one on both sides of the web of material 1, after having first passed by submersion through a chassis 5 containing the padding liquor to be applied. After having jointly passed through the squeezing device, the web of textile 1 padded and simultaneously freed from excess of moisture is separated from the two absorbent webs 4. The latter are circulated again through the bath vessel 5 into the squeezing device 3 via guide rollers 6 serving as tension and guide rollers against a lateral transport of the absorbent webs 4. Before submerging again into the chassis a staple or purifying device for the accompanying fabric may be intercalated into the cycle of the absorbent cloths 4. This device may also contain a drying device and a washing vat.

Figure 2:
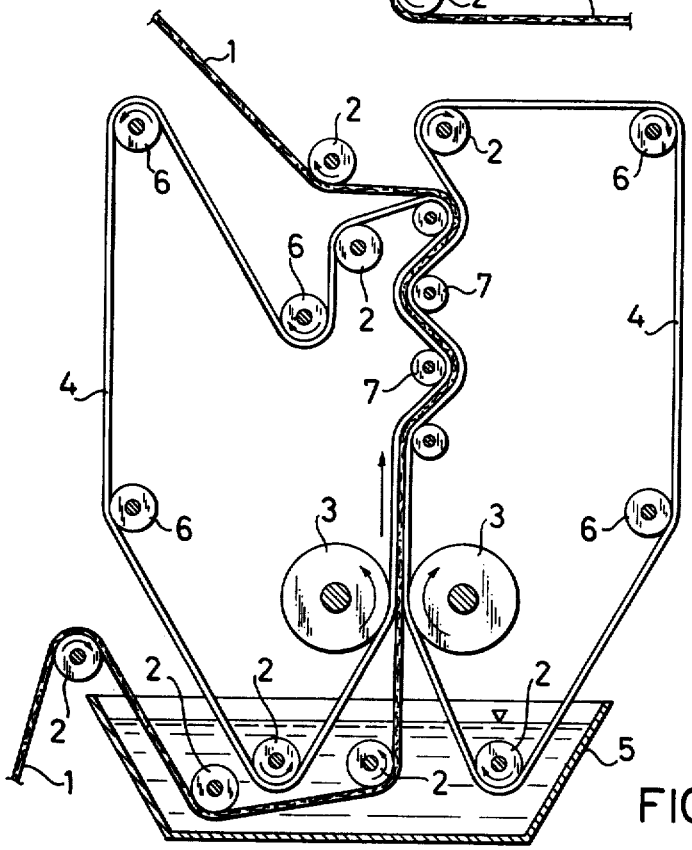

FIG. 2 shows another embodiment of the device, the numbers given as reference numbers having the same meaning as in FIG. 1.

The difference of this apparatus to that described in FIG. 1 consists in that the material to be dyed 1, before passing through the rollers 3 of the squeezing device, is conveyed together with the adsorbent webs 4 (but separately from one another) in a joint bath chassis. Behind the squeezing device further rollers 7 are provided to extend the contact distance between the accompanying absorbent webs 4 and the substrate treated 1.

The technical process achieved according to the invention consists in a decisive reduction of the amount of water to be eliminated by drying and in the saving of energy achieved by this way; furthermore in a highly increased capacity of the technical plants with milder conditions for the material; and finally, more even paddings are obtained with a reduced risk of migration. Thus, modern drying methods, for example high frequency drying, are becoming interesting in practice.

Webs of textile articles of synthetic fibre materials, for example polyester and polyamide fibres, or of mixtures containing at least half of these fibres which are important for the application according to the process of the invention are preferably available as woven or knitted fabrics and as fleeces, but the novel process may also advantageously be used for other endless fibre forms, for example for padding combed materials, warps (beams) and cables.

Nevertheless, the material of cellulose fibres used according to the present invention as absorbent fabric may be used in the form of bulky woven goods.

The following Examples illustrate the invention.

EXAMPLE 1

A polyamide fabric with linen weave having a square meter weight of 60 g was padded with an aqueous solution of 30 g of the acid dyestuff of the formula

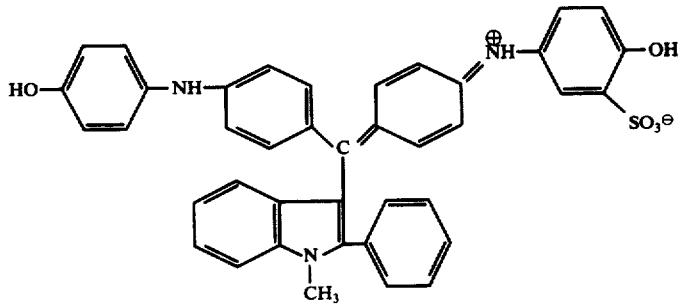

and 20 g of ammonium tartrate per liter of padding liquor in a sandwich package between two duvetine fabrics and squeezed off from the excess of liquor, using the device described in FIG. 1.

Whereas, after applying the bath in the manner described, the two accompanying fabrics were recycled into the padding liquor, the polyamide material was conveyed through a conventional hot flue, wherein the 21% by weight of padding liquor remaining on the material were completely evaporated. Then the dried fabric was overprinted as usual with a printing paste having the usual composition and containing per kg 15 g of the acid dyestuff of the formula

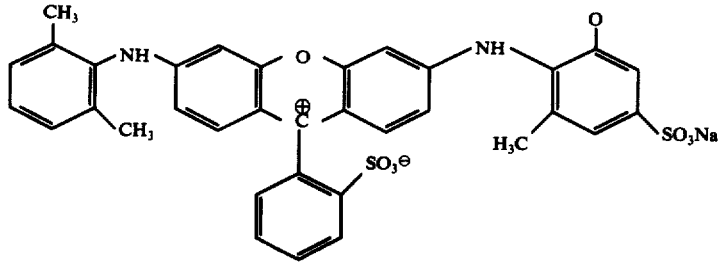

After drying again the material thus treated was steamed for 10 minutes at 100° C, whereby both dyestuffs were fixed. A deep red brown print on a blue ground was obtained.

EXAMPLE 2

After impregnation with an aqueous padding liquor containing per liter 25 g of the disperse dyestuff of the formula

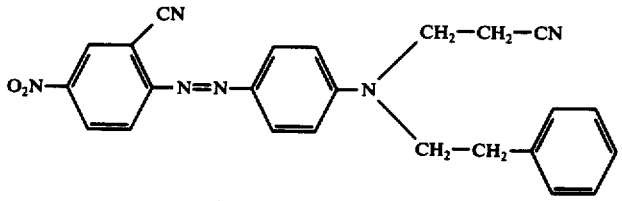

4 g of a mixture of succinic acid ethyl-hexyl ester sulfonate and n-propanol in the ratio of 1 : 1 and 4 g of a polyacrylate, a polyester knitted fabric of texturized threads was squeezed off on the device of the invention between two heavy webs of velvetee fabrics of cotton in the form of a sandwich package.

The synthetic fibre material thus treated having a residual moisture content of 25% by weight was then passed to the following drying and thermofixation device, in this case doing without the otherwise usual intercalation of an infrared dryer. When squeezing off separately in the usual way on the same fabric with the same rollers and the same pressure 125% by weight of the bath would remain on the fibre.

After drying again the padded material was steamed for five minutes at 180° C to fix the dyestuff. After a washing process a red-colored knitted material having a high fastness to washing, to light and to sublimation was obtained.

EXAMPLE 3

A light woven material whose warp consists of endless texturized polyester fibres and whose weft consists of 50% of cotton and 50% of polyester staple fibres, having a square meter weight of 60 g, was padded with an aqueous bath; for preparing this bath 50 g of the dyestuff Reactive Blue 19 (C.I. No. 61200), 20 g of the desperse dyestuff of the formula

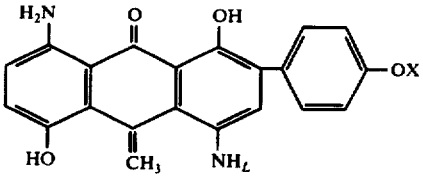

(X = mixture of 40% —H and 60% —$CH_3$)

5 g of crystallized monosodium phosphate, 4 g of a mixture of succinic acid ethyl hexyl ester sulfonate and n-propanol in the ratio of 1 : 8 and 4 g of a polyacrylate per liter of liquid were dissolved in the dyebath; then the material was brought into contact with two webs of a polyamide woven material flocked with spun rayon fibres which had first passed the same bath, and then jointly squeezed off as a sandwich package. After leaving the foulard the bath content of the material was 35% by weight when squeezing off jointly according to the method of the invention, whereas when operating separately the content of residual moisture was 70% by weight.

While the two accompanying webs were recycled to the bath chassis, the light woven material described above was continuously conveyed through a hot air tunnel where it was completely dried.

After the usual measures for thermosoling and for the alkaline wet-treatment to fix both types of dyestuffs and after a washing and drying process an evenly blue-colored fabric was obtained.

What we claim is:

1. A process for the continuous dyeing of a textile web consisting of or containing a major portion of synthetic fibers, by padding the fibrous material with an aqueous dye liquor followed by reducing the moisture content of the web so treated and subsequently fixing the dyestuff, which comprises contacting said textile web soaked with dye liquor, while said web passes through the nip of a pair of squeezing rollers of a padding apparatus in a sandwich-like manner with two endless belts of an absorbent fiber material which envelop the said textile web from both sides and are likewise soaked by dye liquor, squeezing the web between said two layers of absorbent fiber material and continuing said sandwich contact between web and absorbent fiber material for a further time before proceeding with said dyeing operation.

2. Process as claimed in claim 1, wherein the textiles to be dyed are available as mixtures of cellulose or wool fibres and containing at least 50% of synthetic fibre materials.

3. Process as claimed in claim 1, wherein the textiles to be dyed are available as woven or knitted fabrics, as cables, combed material, fibre fleece or warps.

* * * * *